US009335704B2

(12) United States Patent
Takahashi

(10) Patent No.: US 9,335,704 B2
(45) Date of Patent: May 10, 2016

(54) SHEET CONVEYANCE DEVICE AND IMAGE FORMING APPARATUS THAT PROMPTLY REDUCES GENERATION OF ELECTROMOTIVE FORCE DURING JAM PROCESS

(71) Applicant: Kyocera Document Solutions Inc., Osaka (JP)

(72) Inventor: Kazuhiro Takahashi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/754,699

(22) Filed: Jun. 30, 2015

(65) Prior Publication Data

US 2015/0378300 A1 Dec. 31, 2015

(30) Foreign Application Priority Data

Jun. 30, 2014 (JP) ..... 2014-133979

(51) Int. Cl.

*G03G 15/00* (2006.01)
*B41J 29/38* (2006.01)
*G03G 21/16* (2006.01)

(52) U.S. Cl.

CPC ..... *G03G 15/70* (2013.01); *B41J 29/38* (2013.01); *G03G 15/5004* (2013.01); *G03G 15/80* (2013.01); *G03G 21/1638* (2013.01); *B65H 2513/412* (2013.01); *G03G 2215/00548* (2013.01); *G03G 2221/1675* (2013.01)

(58) Field of Classification Search

CPC ..... B65H 2513/412; B65H 2601/111
See application file for complete search history.

(56) References Cited

U.S. PATENT DOCUMENTS 4,260,904 A * 4/1981 Horie ..... G03G 15/5004 271/258.01
7,629,780 B2 * 12/2009 Ogawa ..... G03G 15/5004 323/267
8,695,975 B2 * 4/2014 Seki ..... B65H 7/20 271/265.01
9,052,660 B2 * 6/2015 Mine ..... G03G 15/5004
9,110,393 B2 * 8/2015 Takahashi ..... B41J 11/006

FOREIGN PATENT DOCUMENTS

JP 2008-199707 A 8/2008
JP 2010-028972 A 2/2010

* cited by examiner

*Primary Examiner* — Daniel J Colilla
*Assistant Examiner* — Justin Olamit
(74) *Attorney, Agent, or Firm* — James W. Judge

(57) ABSTRACT

A sheet conveyance device includes: a motor; an ON-OFF control unit, which selectively executes an ON control and an OFF control on the motor; a rotation control unit, which selectively executes a first-direction control and a second direction control; a jam detecting unit; an interlock switch; and a setting unit. The first-direction control sets a rotation direction of the motor as a first direction when the motor is rotated by the ON control. The second direction control sets the rotation direction of the motor as a second direction opposite to the first direction when the motor is rotated by the ON control. The setting unit sets the ON-OFF control unit to perform the ON control and sets the rotation control unit to perform the second direction control when the jam is detected by the jam detecting unit and the interlock switch has been turned off.

4 Claims, 4 Drawing Sheets

SHEET CONVEYANCE DEVICE AND IMAGE FORMING APPARATUS THAT PROMPTLY REDUCES GENERATION OF ELECTROMOTIVE FORCE DURING JAM PROCESS

INCORPORATION BY REFERENCE

This application is based upon, and claims the benefit of priority from, corresponding Japanese Patent Application No. 2014-133979 filed in the Japan Patent Office on Jun. 30, 2014, the entire contents of which are incorporated herein by reference.

BACKGROUND

Unless otherwise indicated herein, the description in this section is not prior art to the claims in this application and is not admitted to be prior art by inclusion in this section.

An image forming apparatus conveys a paper sheet along a conveyance path using a rotating roller, forms an image on the conveyed paper sheet, and outputs the paper sheet. When a paper sheet gets stuck in the conveyance path (that is, when a jam occurs), the user needs to remove the paper sheet, which has got stuck in the conveyance path, so as to release the jam. When the jammed paper sheet is pulled out from the roller to remove the jammed paper sheet from the conveyance path, the roller rotates and this rotation drives the motor to rotate so as to cause an electromotive force (hereinafter referred to as the electromotive force during the jam process).

The electromotive force during the jam process might cause a malfunction of the circuit of the image forming apparatus. An increase in force for pulling out the jammed paper sheet from the roller increases the rotation speed of the motor, thus increasing the electromotive force during the jam process. This might break the circuit of the image forming apparatus.

Therefore, a proposed technology rotates a motor using an electromotive force during the jam process when it is generated, so as to consume the electromotive force during the jam process.

Another proposed technology interlocks the opening-closing operation of the cover of an image forming apparatus and the operation of an interlock switch. In this technology, when the cover is closed, the motor is connected to a motor power supply (24V power supply) by the interlock switch. When the cover is opened, the motor is connected to another power supply (5V power supply) by the interlock switch. When an electromotive force during the jam process occurs in the state where the cover is opened, the current caused by this electromotive force flows to the other power supply.

SUMMARY

A sheet conveyance device according to one aspect of the disclosure includes a motor, an ON-OFF control unit, a rotation control unit, a conveyance path for a sheet, a roller, a jam detecting unit, a cover, an interlock switch, and a setting unit. The ON-OFF control unit selectively executes an ON control and an OFF control. The ON control causes the motor to rotate when electric power is supplied to the motor. The OFF control causes the motor not to rotate even when electric power is supplied to the motor. The rotation control unit selectively executes a first-direction control and a second direction control. The first-direction control sets a rotation direction of the motor as a first direction when the motor is rotated by the ON control. The second direction control sets the rotation direction of the motor as a second direction opposite to the first direction when the motor is rotated by the ON control. The roller is driven by the rotation of the motor when the motor rotates in the first direction, to rotate in a third direction so as to convey the sheet along the conveyance path. The jam detecting unit detects a jam of the sheet conveyed along the conveyance path. The cover is opened at a time of access to the conveyance path, to release the jam. The interlock switch is turned off in a state where the cover is opened, so as to cut off a supply of electric power from a power supply to the motor. A rotation direction of the roller when the jammed sheet is pulled out from the roller is preliminarily determined as the third direction among the third direction and a fourth direction. The fourth direction is opposite to the third direction. The setting unit sets the ON-OFF control unit to perform the ON control and sets the rotation control unit to perform the second direction control when the jam is detected by the jam detecting unit and the interlock switch has been turned off.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
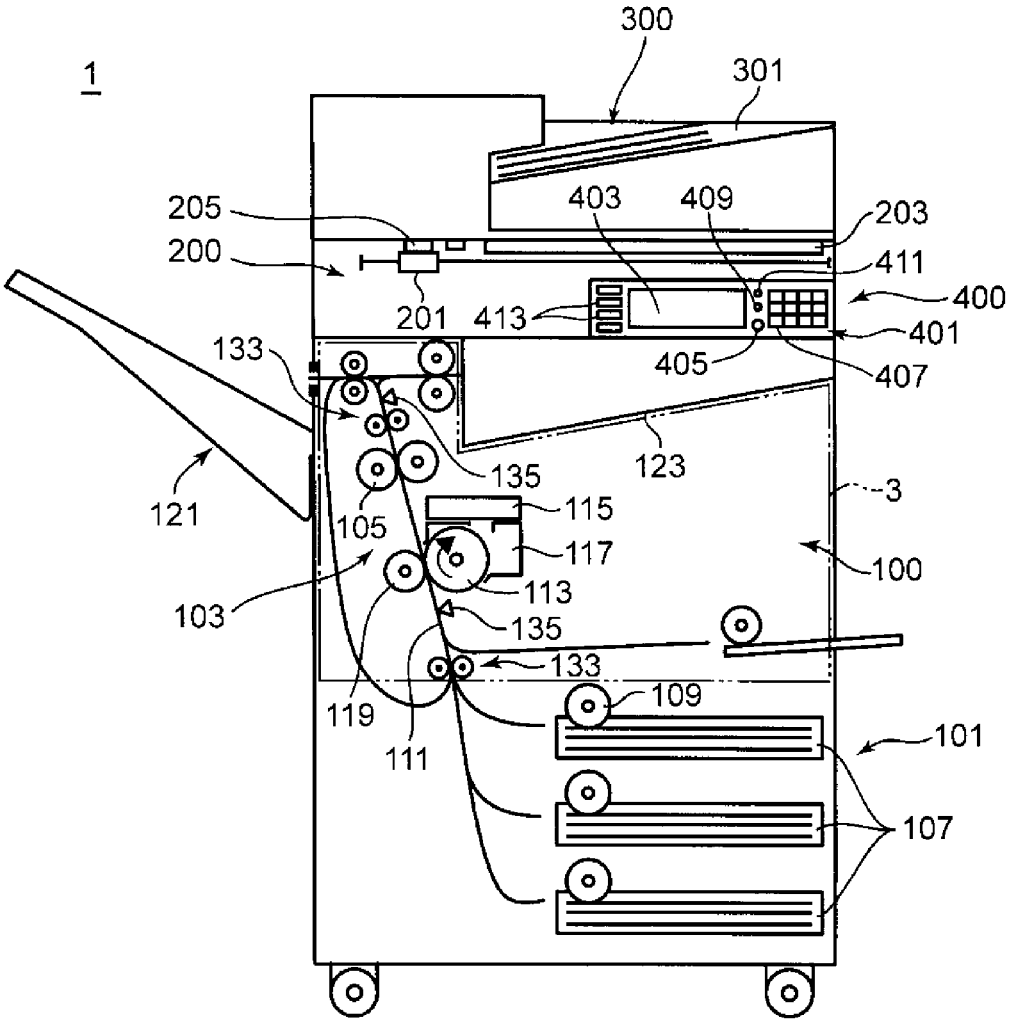
FIG. 1 illustrates the outline of the internal structure of an image forming apparatus that includes a sheet conveyance device according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes embodiments of the disclosure in detail based on the drawings. FIG. 1 is an explanatory diagram for describing the outline of the internal structure of an image forming apparatus 1, which includes a sheet conveyance device, according to one embodiment of the disclosure. The image forming apparatus 1 can be applied to, for example, digital multi-functional peripherals that have the functions of copying, printer, scanner, facsimile, and similar function. The image forming apparatus 1 includes: an apparatus main body 100; a document reading unit 200, which is arranged on the apparatus main body 100; a document feeding unit 300, which is arranged on the document reading unit 200; and an operation unit 400, which is arranged on upper front face of the apparatus main body 100.

The document feeding unit 300 functions as an automatic document feed. The document feeding unit 300 can feed a plurality of documents placed on a document platen 301 to the document reading unit 200 such that the documents can be continuously read.

The document reading unit 200 includes: a carriage 201, where an exposing lamp and similar member are mounted; a platen 203, which is constituted of a transparent member such as glass; a charge coupled device (CCD) sensor (not illustrated); and a document reading slit 205. To read the documents placed on the platen 203, the carriage 201 moves in the longitudinal direction of the platen 203 while the CCD sensor reads the document. In contrast, to read the documents fed by the document feeding unit 300, the carriage 201 moves to the position facing the document reading slit 205 while the CCD sensor reads the document fed by the document feeding unit 300 via the document reading slit 205. The CCD sensor outputs the data read from the document as image data.

The apparatus main body 100 includes a paper sheet storage unit 101, an image forming unit 103, and a fixing unit 105. The paper sheet storage unit 101 is arranged in the lowest portion inside the apparatus main body 100. The paper sheet storage unit 101 includes a paper sheet tray 107, which can store the bundle of papers. The top paper sheet of the bundle of papers stored in the paper sheet tray 107 is delivered toward a paper sheet conveyance passage 111 (one example of a conveyance path) by driving of a pickup roller 109.

In the paper sheet conveyance passage 111, a plurality of roller pairs 133 of various rollers such as a registration roller and a conveyance roller is arranged. The paper sheet conveyance passage 111 and the roller pair 133 constitute the sheet conveyance device according to this embodiment.

Figure 3:
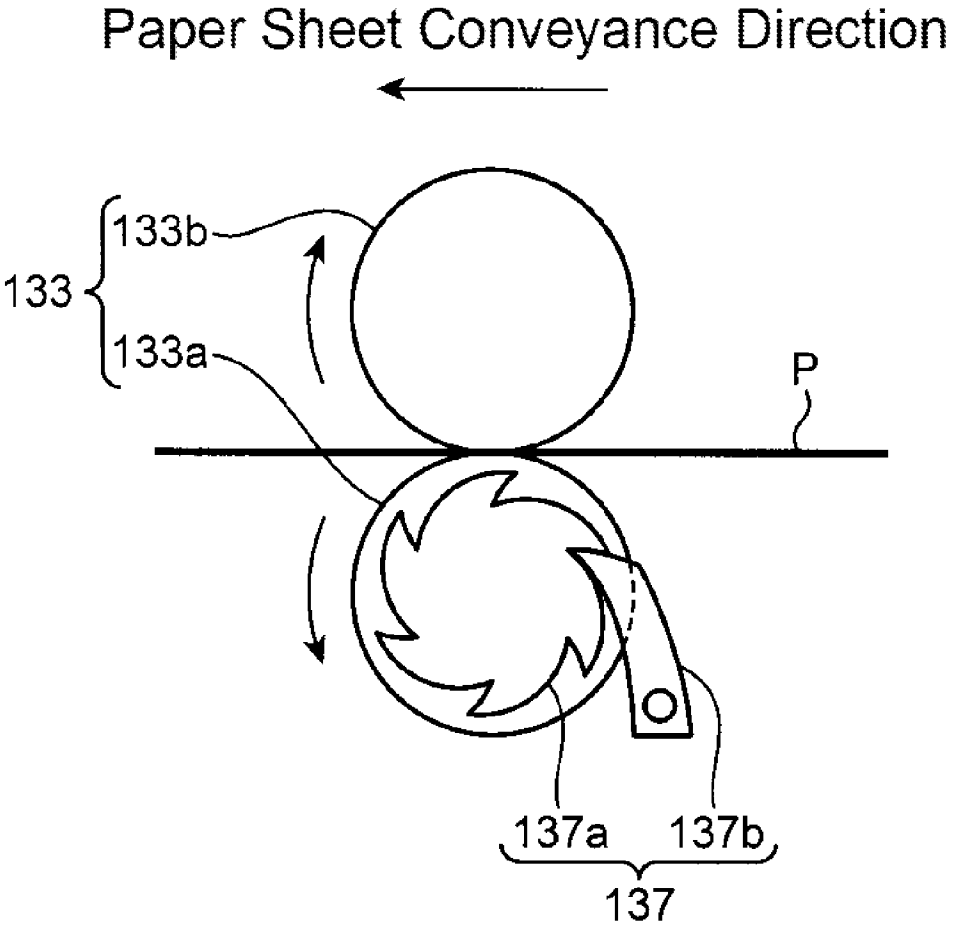
FIG. 3 schematically illustrates the configuration of a roller pair.

FIG. 3 is a schematic diagram illustrating the configuration of the roller pair 133. The roller pair 133 is constituted of a drive roller 133*a* and a driven roller 133*b*. The drive roller 133*a* and the driven roller 133*b* sandwiches a paper sheet P (one example of a sheet) and then the drive roller 133*a* and the driven roller 133*b* rotates, so as to convey the paper sheet P from the upstream to downstream along the paper sheet conveyance passage 111 (in FIG. 1).

The drive roller 133*a* is rotatable only in the rotation direction (anticlockwise in FIG. 3) in which the paper sheet P is fed to the downstream of the paper sheet conveyance passage 111, by a ratchet mechanism 137. The ratchet mechanism 137 is constituted of a gear 137*a* and a ratchet pawl 137*b*. The gear 137*a* is mounted on the surface of the end portion of the drive roller 133*a* coaxially with the drive roller 133*a*. The ratchet pawl 137*b* engages with the gear 137*a* when the drive roller 133*a* rotates clockwise, so as to block the clockwise rotation of the drive roller 133*a*.

The description returns to FIG. 1. A plurality of jam detection sensors 135 (one example of a jam detecting unit) are arranged at different positions in the paper sheet conveyance passage 111. The jam detection sensor 135 detects the jam of the paper sheet conveyed along the paper sheet conveyance passage 111.

The image forming unit 103 forms a toner image on the conveyed paper sheet. The image forming unit 103 includes a photoreceptor drum 113, an exposure unit 115, a developing unit 117, and a transfer unit 119. The exposure unit 115 generates a modulated light corresponding to the image data (such as image data output from the document reading unit 200, image data transmit from the PC, and facsimile reception image data), and irradiates the uniformly charged circumference surface of the photoreceptor drum 113 with the light. This forms an electrostatic latent image, which corresponds to the image data, on the circumference surface of the photoreceptor drum 113. In this state, toner is supplied from the developing unit 117 to the circumference surface of the photoreceptor drum 113 so as to form the toner image corresponding to the image data on the circumference surface. This toner image is transferred to the paper sheet, which is conveyed from the above-described paper sheet storage unit 101, by the transfer unit 119.

The paper sheet on which the toner image is transferred is fed to the fixing unit 105. In the fixing unit 105, heat and pressure are applied to the toner image and the paper sheet, and the toner image is fixed on the paper sheet. The paper sheet is discharged to a stack tray 121 or a sheet discharge tray 123.

The image forming apparatus 1 includes a cover 3, which covers the inside of the apparatus main body 100. When the cover 3 is opened, the paper sheet conveyance passage 111 appears. When a jam of the paper sheet occurs in the paper sheet conveyance passage 111, the user opens the cover 3 and pulls out the jammed paper sheet from the roller pair 133 to remove the jammed paper sheet from the paper sheet conveyance passage 111. The cover 3 is one example of a cover that is opened at the time of access to the conveyance path, to release a jam.

The operation unit 400 includes an operation key portion 401 and a display unit 403. The display unit 403 has a touch panel function and displays the screen including software keys. The user operates the software keys while watching the screen to configure settings required for executing a function such as copying.

The operation key portion 401 includes operation keys constituted of hardware keys. Specifically, the operation key portion 401 includes a start key 405, a numeric keypad 407, a stop key 409, a reset key 411, a function switching key 413, which switches copying, printer, scanner, and facsimile, and similar member.

The start key 405 is a key that starts operations such as copying and facsimile transmission. The numeric keypad 407 is a key that receives numerals such as the number of copies or facsimile numbers. The stop key 409 is a key that aborts operations such as copying in its course. The reset key 411 is a key that resets a set content to the initial setting.

The function switching key 413 includes a copying key, a transmission key, and a similar key, and is a key that switches mutually between, for example, copy function and transmitting function. Operating the copying key displays the initial screen of copying on the display unit 403. Operating the transmission key displays the initial screen of facsimile transmission and e-mail transmission on the display unit 403.

Figure 2:
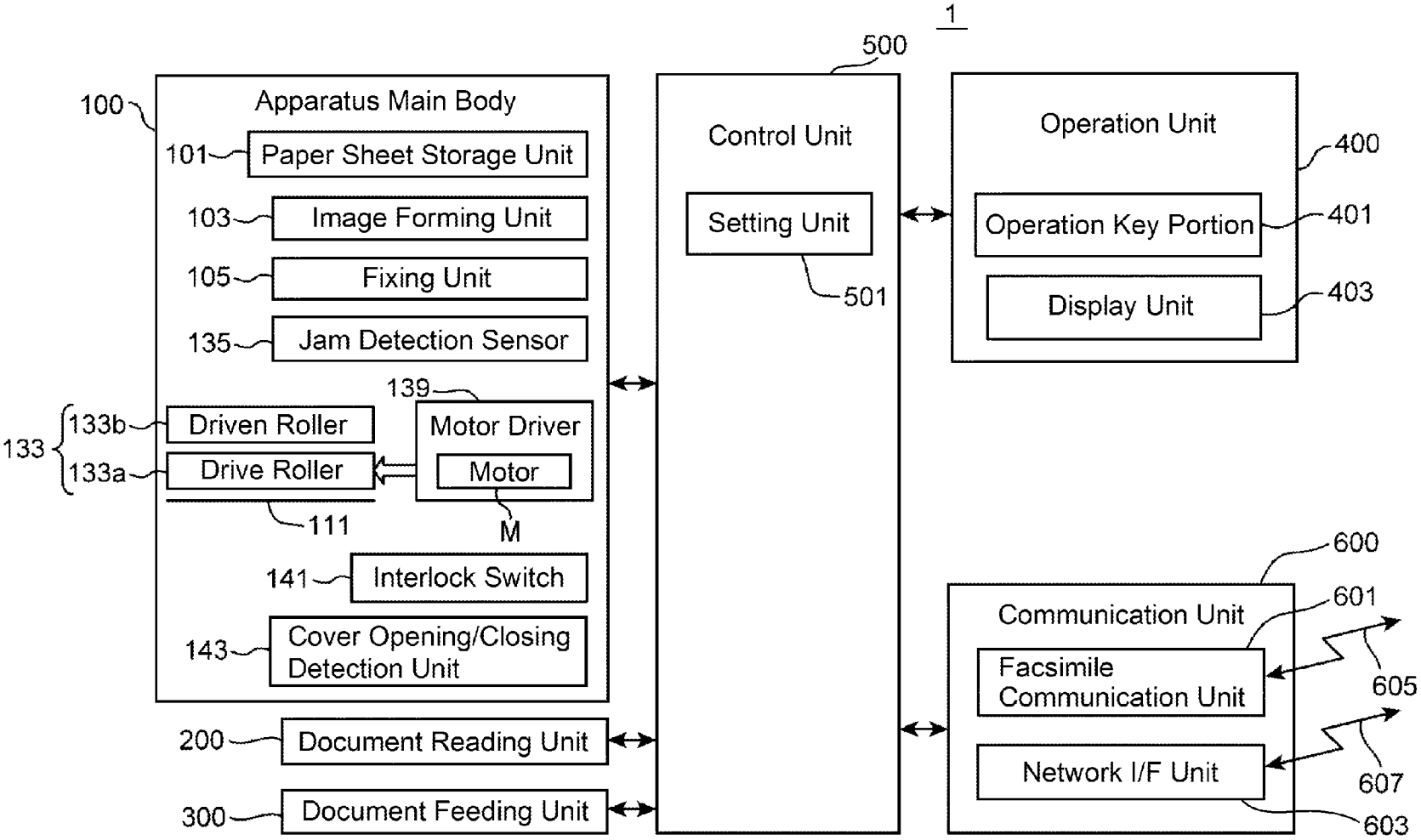
FIG. 2 illustrates the configuration of the image forming apparatus illustrated in FIG. 1.

FIG. 2 is a block diagram illustrating the configuration of the image forming apparatus 1 illustrated in FIG. 1. The image forming apparatus 1 has the configuration where the apparatus main body 100, the document reading unit 200, the document feeding unit 300, the operation unit 400, a control unit 500, and a communication unit 600 are mutually connected with a bus. The description of the configuration that has been described using FIG. 1 will be omitted.

The apparatus main body 100 further includes a motor M, a motor driver 139, an interlock switch 141, and a cover opening/closing detection unit 143.

The motor M generates the power to rotate the drive roller 133*a*. As illustrated in FIG. 3, the drive roller 133*a* rotates anticlockwise by the driving power of the motor M and this rotation drives the driven roller 133*b* to rotate clockwise. The drive roller 133*a* and the driven roller 133*b* rotate while the paper sheet P is sandwiched by the drive roller 133*a* and the driven roller 133*b*, so as to convey the paper sheet P.

The drive roller 133*a* is a roller that is driven by the rotation of the motor M when the motor M rotates in a first direction, to rotate in a third direction so as to convey the paper sheet P along the paper sheet conveyance passage 111.

Here, the rotation of the motor M in the first direction means that the motor M makes one of normal rotation and reverse rotation. The rotation of the motor M in a second direction means that the motor M makes the other of normal rotation and reverse rotation (rotation in the reverse direction of the first direction).

The rotation of the drive roller 133*a* in the third direction means the rotation in the direction in which the paper sheet P is fed to the downstream of the paper sheet conveyance passage 111 (anticlockwise in FIG. 3). The rotation of the drive roller 133*a* in a fourth direction means the rotation in the direction in which the paper sheet P is returned to the upstream of the paper sheet conveyance passage 111 (clockwise in FIG. 3). In this embodiment, the third direction is described as the anticlockwise direction and the fourth direction is described as the clockwise direction. However, these directions may be opposite to each other.

The ratchet mechanism 137 functions as a restricting unit that restricts the rotation direction of the drive roller 133*a* to the third direction from the third direction and the fourth direction opposite to the third direction.

The description returns to FIG. 2. The motor driver 139 is a device that drivingly controls the motor M. The motor driver 139 has the functions of an ON-OFF control unit and a rotation control unit.

The ON-OFF control unit is a control unit that can selectively execute an ON control and an OFF control. The ON control rotates the motor M when electric power is supplied to the motor M. The OFF control does not rotate the motor M even when electric power is supplied to the motor M.

The rotation control unit is a control unit that can selectively execute a first-direction control and a second direction control. When the motor M is rotated by the ON control, the first-direction control sets the rotation direction of the motor M to the first direction, and the second direction control sets the rotation direction of the motor M to the second direction opposite to the first direction.

The interlock switch 141 is turned off in the state where the cover 3 (in FIG. 1) is opened. This cuts off the supply of electric power from the power supply to the motor M. The interlock switch 141 is turned on in the state where the cover 3 is closed. This causes the supply of electric power from the power supply to the motor M.

The cover opening/closing detection unit 143 detects opening and closing of the cover 3.

The control unit 500 includes a central processing unit (CPU), a read only memory (ROM), a random access memory (RAM), an image memory, and similar member. The CPU executes a control required for operation of the image forming apparatus 1 with respect to the above-described components such as the apparatus main body 100 in the image forming apparatus 1. The ROM stores software required to control the operation of the image forming apparatus 1. The RAM is used, for example, to temporarily store data generated during execution of the software and to store the application software. The image memory temporarily stores image data (such as image data output from the document reading unit 200, image data transmitted from the PC, and facsimile reception image data).

The control unit 500 includes a setting unit 501 as a function block. When a jam is detected by the jam detection sensor 135 and the interlock switch 141 is turned off (that is, in the state where the cover 3 is opened), the setting unit 501 sets the ON-OFF control unit (the motor driver 139) to perform the ON control and sets the rotation control unit (the motor driver 139) to perform the second direction control.

The communication unit 600 includes a facsimile communication unit 601 and a network I/F unit 603. The facsimile communication unit 601 includes a network control unit (NCU), which controls the telephone line connection with the other side of the facsimile, and a modulation-demodulation circuit, which modulates and demodulates the signal for the facsimile communication. The facsimile communication unit 601 is connected to a telephone line 605.

The network I/F unit 603 is connected to a local area network (LAN) 607. The network I/F unit 603 is a communication interface circuit for executing communication with the terminal device such as the PC connected to the LAN 607.

Figure 4:
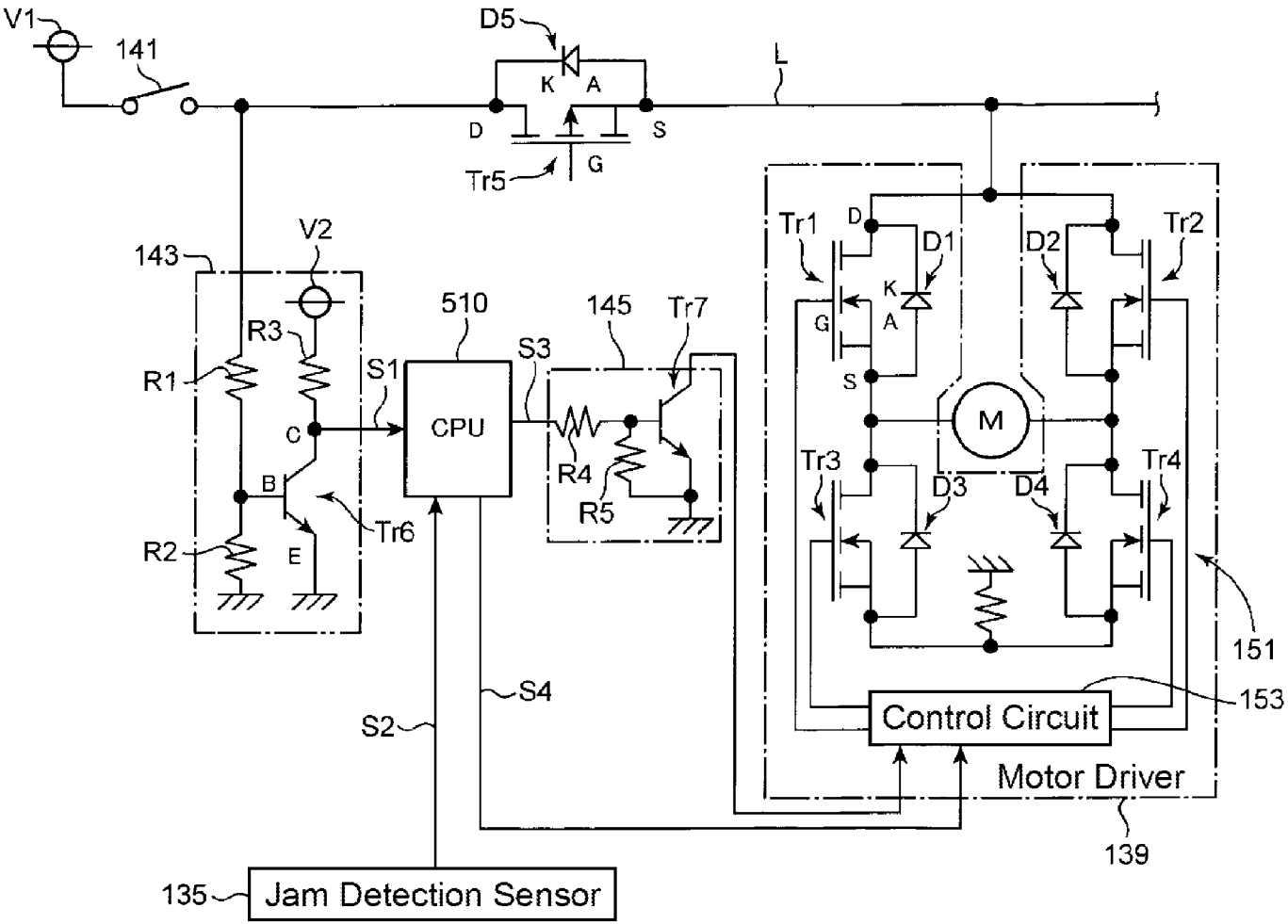
FIG. 4 illustrates the connection relationship between a motor, a motor driver, an interlock switch, a cover opening/closing detection unit, and similar member included in the image forming apparatus according to this embodiment.

FIG. 4 is a circuit diagram illustrating the connection relationship between the motor M, the motor driver 139, the interlock switch 141, the cover opening/closing detection unit 143, and similar member included in the image forming apparatus 1 according to this embodiment.

The motor driver 139 includes an H-bridge circuit 151 and a control circuit 153, and realizes the functions of the ON-OFF control unit and the rotation control unit.

The H-bridge circuit 151 is constituted of n-channel power MOS transistors Tr1, Tr2, Tr3, and Tr4 and diodes D1, D2, D3, and D4.

The drain of the power MOS transistor Tr1 and the drain of the power MOS transistor Tr2 are connected together. These drains are connected to a power supply line L. The source of the power MOS transistor Tr3 and the source of the power MOS transistor Tr4 are connected together. These sources are grounded.

The source of the power MOS transistor Tr1 and the drain of the power MOS transistor Tr3 are connected together. These terminals and the motor M are connected together. The source of the power MOS transistor Tr2 and the drain of the power MOS transistor Tr4 are connected together. These terminals and the motor M are connected together.

The control circuit 153 transmits an ON signal and an OFF signal to the respective gates of the power MOS transistors Tr1, Tr2, Tr3, and Tr4. To cause normal rotation of the motor M, the control circuit 153 transmits the ON signal to the respective gates of the power MOS transistors Tr1 and Tr4 to turn on the power MOS transistors Tr1 and Tr4 and transmits the OFF signal to the respective gates of the power MOS transistors Tr2 and Tr3 to turn off the power MOS transistors Tr2 and Tr3. To cause reverse rotation of the motor M, the control circuit 153 transmits the ON signal to the respective gates of the power MOS transistors Tr2 and Tr3 to turn on the power MOS transistors Tr2 and Tr3 and transmits the OFF signal to the respective gates of the power MOS transistors Tr1 and Tr4 to turn off the power MOS transistors Tr1 and Tr4.

The source of the power MOS transistor Tr1 and the anode of the diode D1 are connected together. The drain of the power MOS transistor Tr1 and the cathode of the diode D1 are connected together. Similarly, the source of the power MOS transistor Tr2 (Tr3 or Tr4) and the anode of the diode D2 (D3 or D4) are connected together. The drain of the power MOS transistor Tr2 (Tr3 or Tr4) and the cathode of the diode D2 (D3 or D4) are connected together.

The rotation of the motor M generates a counter-electromotive force. The diode D1 is disposed to prevent the power MOS transistor Tr1 from being broken by the counter-electromotive force when the power MOS transistor Tr1 is turned off. Similarly, the diode D2 (D3 or D4) is disposed to prevent the power MOS transistor Tr2 (Tr3 or Tr4) from being broken by the counter-electromotive force when the power MOS transistor Tr2 (Tr3 or Tr4) is turned off. The diodes D1 to D4 are referred to as freewheeling diodes.

Electric power is supplied to the motor M from the power supply line L. The power supply line L is connected to an internal power supply V1 by closing the cover 3 so as to turn on the interlock switch 141. The connection with the internal power supply V1 is cut off by opening the cover 3 so as to turn off the interlock switch 141. The voltage of the internal power supply V1 is, for example, +24V.

The power supply line L is disconnected in its course, and a p-channel power MOS transistor Tr5 is arranged there. The source of the power MOS transistor Tr5 is connected to the power supply line L at the H-bridge circuit 151 side. The drain of the power MOS transistor Tr5 is connected to the power supply line L at the interlock switch 141 side.

The power MOS transistor Tr5 is turned off at the time of a sleep mode of the image forming apparatus 1 so as not to supply electric power to the motor M from the internal power supply V1. The power MOS transistor Tr5 is turned on at the time of a normal mode of the image forming apparatus 1 so as to supply electric power to the motor M from the internal power supply V1. The signal to turn on and off the power MOS transistor Tr5 is transmitted from a CPU 510.

The source of the power MOS transistor Tr5 and the anode of a diode D5 are connect together. The drain of the power MOS transistor Tr5 and the cathode of the diode D5 are connect together.

The cover opening/closing detection unit 143 is connected to the power supply line L at the drain side of the power MOS transistor Tr5. The cover opening/closing detection unit 143 determines that the cover 3 is closed when electric power is supplied to the cover opening/closing detection unit 143 from the power supply line L, and determines that the cover 3 is opened when electric power is not supplied to the cover opening/closing detection unit 143 from the power supply line L.

The cover opening/closing detection unit 143 is constituted of resistors R1, R2, and R3 and an NPN transistor Tr6. The resistors R1 and R2 constitute a voltage-dividing circuit. The resistor R1 is connected to the power supply line L, and the resistor R2 is grounded.

The output of the voltage-dividing circuit is connected to the base of the NPN transistor Tr6. The emitter of the NPN transistor Tr6 is grounded. The collector of the NPN transistor Tr6 is connected to the internal power supply V2 via the resistor R3. The voltage of the internal power supply V2 is, for example, +3.3V.

The signal output from the collector of the NPN transistor Tr6 is transmitted to the CPU 510 as a cover opening/closing detection signal S1.

In the state where the cover 3 is opened (that is, the interlock switch 141 is in the OFF state), the NPN transistor Tr6 becomes the OFF state. Accordingly, the cover opening/closing detection unit 143 transmits the cover opening/closing detection signal S1 (the signal indicative of opening of the cover 3) at the H level to the CPU 510.

In the state where the cover 3 is closed (that is, the interlock switch 141 is in the ON state), the NPN transistor Tr6 becomes the ON state. Accordingly, the cover opening/closing detection unit 143 transmits the cover opening/closing detection signal S1 (the signal indicative of closing of the cover 3) at the L level to the CPU 510.

The CPU 510 and a remote signal generating unit 145 achieve the function of the setting unit 501 illustrated in FIG. 2. The CPU 510 receives a jam detection signal S2 in addition to the cover opening/closing detection signal S1 described above. The jam detection sensor 135 illustrated in FIG. 1 generates the jam detection signal S2 when detecting the occurrence of a jam in the paper sheet conveyance passage 111.

The CPU 510 outputs an ON-OFF control signal S3. The ON-OFF control signal S3 is a signal for setting the ON control and the OFF control to the motor driver 139. The ON control is a control that rotates the motor M when electric power is supplied to the motor M. The OFF control is a control that does not rotate the motor M even when electric power is supplied to the motor M.

The ON-OFF control signal S3 is input to the remote signal generating unit 145. The remote signal generating unit 145 is constituted of: an NPN transistor Tr7; a resistor R4 connected to the base of the NPN transistor Tr7; and a resistor R5 connecting the base and the emitter of the NPN transistor Tr7 together. The emitter of the NPN transistor Tr7 is grounded. The collector of the NPN transistor Tr7 is connected to the control circuit 153.

When the ON-OFF control signal S3 at the H level is transmitted from the CPU 510 to the base of the NPN transistor Tr7, the NPN transistor Tr7 is turned on so as to transmit an L-level signal to the control circuit 153. Accordingly, the ON control is set in the motor driver 139.

On the other hand, when the ON-OFF control signal S3 at the L level is transmitted from the CPU 510 to the base of the NPN transistor Tr7, the NPN transistor Tr7 is turned off so as to transmit a floating signal to the control circuit 153. Accordingly, the OFF control is set in the motor driver 139.

The CPU 510 outputs a rotation-direction selection signal S4. The rotation-direction selection signal S4 output from the CPU 510 is transmitted to the control circuit 153. When the rotation-direction selection signal S4 at the H level output from the CPU 510 is transmitted to the control circuit 153, one of the first-direction control and the second direction control is set in the motor driver 139. When the rotation-direction selection signal S4 at the L level output from the CPU 510 is transmitted to the control circuit 153, the other of the first-direction control and the second direction control is set in the motor driver 139.

The first-direction control is a control that sets the rotation direction of the motor M as the first direction when the motor M is rotated by the ON control. The second direction control is a control that sets the rotation direction of the motor M as the second direction when the motor M is rotated by the ON control.

A description will be given of the operation of the circuit illustrated in FIG. 4. When a jam occurs in the paper sheet conveyance passage 111 (in FIG. 1), the jam detection sensor 135 outputs the jam detection signal S2. When the user opens the cover 3 (in FIG. 1) to release the jam, the interlock switch 141 is turned off. Accordingly, the cover opening/closing detection unit 143 outputs the cover opening/closing detection signal S1 indicative of opening of the cover 3.

The jam detection signal S2 and the cover opening/closing detection signal S1 indicative of opening of the cover 3 are input to the CPU 510 such that the CPU 510 outputs the ON-OFF control signal S3 for setting the ON control and the rotation-direction selection signal S4 for setting the second direction control. Accordingly, the motor driver 139 is set to perform the ON control, which rotates the motor M when electric power is supplied to the motor M, and is set to use the rotation direction of the motor M as the second direction when the motor M is rotated by the ON control.

In this embodiment, as illustrated in FIG. 3, the rotation direction of the drive roller 133*a* is restricted to the third direction (which is the rotation direction in which the paper sheet P is transmitted to the downstream of the paper sheet conveyance passage 111, in FIG. 3, anticlockwise) by the ratchet mechanism 137. Accordingly, the rotation direction of the drive roller 133*a* when the jammed paper sheet P is pulled out from the roller pair 133 is preliminarily determined as the third direction from the third direction and the fourth direction opposite to the third direction.

Accordingly, when the user pulls out the jammed paper sheet P from the roller pair 133, the drive roller 133*a* rotates in the third direction and this rotation drives the motor M to rotate in the first direction so as to generate an electromotive force during the jam process.

Because the motor driver 139 is set as described above (the ON control is set and the second direction control is set), the motor M is controlled to be rotated in the second direction by the electromotive force during the jam process. Accordingly, the force to cause rotation of the motor M in the first direction is cancelled so as to promptly stop the rotation of the motor M.

A description will be given of the main effects according to this embodiment. In this embodiment, as illustrated in FIG. 1 and FIG. 3, the motor M rotates in the first direction and this rotation drives the drive roller 133*a* to rotate in the third direction so as to convey a paper sheet along the paper sheet conveyance passage 111. Additionally, the rotatable direction of the drive roller 133*a* when the jammed paper sheet P is pulled out from the roller pair 133 is preliminarily determined as the third direction. Accordingly, when the jammed paper sheet P is pulled out from the roller pair 133, the motor M rotates in the first direction.

According to this embodiment, when a jam is detected and the interlock switch 141 is turned off (that is, in the state where the cover 3 is opened), the motor driver 139 is set to perform the ON control and is set to perform the second direction control. Accordingly, when the electromotive force during the jam process (that is, the electromotive force generated by the rotation of the motor M driven by the rotation of the drive roller 133*a* when the jammed paper sheet P is pulled out from the roller pair 133 and the jammed paper sheet P is removed from the paper sheet conveyance passage 111) reaches the value that causes rotation of the motor M, the motor M is controlled to be rotated in the second direction. This cancels the force to cause rotation of the motor M in the first direction so as to promptly stop the rotation of the motor M. Accordingly, this embodiment promptly stops the occurrence of the electromotive force during the jam process (Effect 1).

With this embodiment, Effect 1 described above can be obtained by changing software without adding a new component or circuit.

This embodiment further provides the following effect. With reference to FIG. 3, the image forming apparatus 1 includes: a first aspect (1-WAY structure) that restricts the rotatable direction of the drive roller 133*a* when the jammed paper sheet P is pulled out from the roller pair 133, only to the third direction (the rotation direction in which the paper sheet P is fed to the downstream of the paper sheet conveyance passage 111); and a second aspect (2-WAY structure) that permits any of the third direction and the fourth direction (the rotation direction in which the paper sheet P is returned to the upstream of the paper sheet conveyance passage 111) opposite to the third direction.

In the case of the second aspect, the drive roller 133*a* can be rotated in the third direction so as to pull out the jammed paper sheet P from the roller pair 133. The drive roller 133*a* can be rotated in the fourth direction so as to pull out the jammed paper sheet P from the roller pair 133. However, when the drive roller 133*a* is rotated in the fourth direction to pull out the jammed paper sheet P from the roller pair 133, the motor M rotates in the second direction and thus Effect 1 described above cannot be obtained.

This embodiment employs the first aspect. When the jammed paper sheet P is pulled out from the roller pair 133, the rotation direction of the drive roller 133*a* is restricted to the third direction by the ratchet mechanism 137 illustrated in FIG. 3. Accordingly, the drive roller 133*a* cannot be rotated in the fourth direction to pull out the jammed paper sheet P from the roller pair 133, and the drive roller 133*a* needs to be rotated in the third direction to pull out the jammed paper sheet P from the roller pair 133. This reliably achieves Effect 1 described above (Effect 2).

With reference to FIG. 4, according to this embodiment, the cover opening/closing detection unit 143 determines that the cover 3 (in FIG. 1) is closed when receiving electric power supplied from the power supply line L, and determines that the cover 3 is opened when not receiving electric power supplied from the power supply line L. Accordingly, when the electromotive force during the jam process is transmitted to the cover opening/closing detection unit 143 via the power supply line L, the closed state of the cover 3 might be erroneously detected even in the state where the cover 3 is opened.

This embodiment can promptly stop the occurrence of the electromotive force during the jam process (Effect 1), thus promptly releasing the erroneously detected state described above (Effect 3).

A description will be given of a modification of this embodiment. The modification employs the second aspect described above. In the modification, the pull-out direction of the paper sheet P is indicated by an arrow mark or similar mark such that the drive roller 133*a* is rotated in the third direction to pull out the jammed paper sheet P from the roller pair 133. This prevents the drive roller 133*a* from being rotated in the fourth direction to pull out the jammed paper sheet P from the roller pair 133.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A sheet conveyance device, comprising:

a motor;

an ON-OFF control unit that selectively executes an ON control and an OFF control, the ON control causing the motor to rotate when electric power is supplied to the motor, the OFF control causing the motor not to rotate even when electric power is supplied to the motor;

a rotation control unit that selectively executes a first-direction control and a second direction control, the first-direction control setting a rotation direction of the motor as a first direction when the motor is rotated by the ON control, the second direction control setting the rotation direction of the motor as a second direction opposite to the first direction when the motor is rotated by the ON control;

a conveyance path for a sheet;

a roller that is driven by the rotation of the motor when the motor rotates in the first direction, to rotate in a third direction so as to convey the sheet along the conveyance path;

a jam detecting unit that detects a jam of the sheet conveyed along the conveyance path;

a cover that is opened at a time of access to the conveyance path, to release the jam; and an interlock switch that is turned off in a state where the cover is opened, so as to cut off a supply of electric power from a power supply to the motor; wherein a rotation direction of the roller when the jammed sheet is pulled out from the roller is preliminarily determined as the third direction among the third direction and a fourth direction, the fourth direction being opposite to the third direction, and the sheet conveyance device further includes a setting unit that sets the ON-OFF control unit to perform the ON control and sets the rotation control unit to perform the second direction control if the jam is detected by the jam detecting unit and the interlock switch has been turned off.

2. The sheet conveyance device according to claim 1, further comprising:

a restricting unit that restricts a rotation direction of the roller to the third direction among the third direction and the fourth direction; wherein the restricting unit restricts a rotatable direction of the roller to the third direction when the jammed sheet is pulled out from the roller.

3. The sheet conveyance device according to claim 1, further comprising:

a power supply line that supplies electric power to the motor; wherein the power supply line is connected to the power supply when the cover is closed and the interlock switch is turned on, and the connection with the power supply is cut off when the cover is opened and the interlock switch is turned off, and the sheet conveyance device further includes a cover opening/closing detection unit that determines that the cover is closed when receiving electric power supplied from the power supply line, and that determines that the cover is opened when not receiving electric power supplied from the power supply line.

4. An image forming apparatus, comprising:

a sheet conveyance device according to claim 1, the sheet conveyance device conveying a paper sheet as the sheet; and an image forming unit that forms an image on the paper sheet conveyed by the sheet conveyance device and outputs the paper sheet.

* * * * *